United States Patent [19]

Jackson et al.

[11] 4,214,633

[45] Jul. 29, 1980

[54] SOIL STABILIZER AND TOOTH HOLDER THEREFOR

[75] Inventors: Gary L. Jackson, S. Charleston; Prabhakar B. Rao, Fairborn, both of Ohio

[73] Assignee: Koehring Company, Brookfield, Wis.

[21] Appl. No.: 841,015

[22] Filed: Oct. 11, 1977

[51] Int. Cl.[3] ..... A01B 33/02; A01B 33/14

[52] U.S. Cl. ..... 172/123; 172/713; 299/91

[58] Field of Search ..... 172/123, 60, 118, 125, 172/734, 739, 740, 749, 762, 713, 550; 37/141 T, 142 R, 91-97, 189; 299/91

[56] References Cited

U.S. PATENT DOCUMENTS

| | | | |
|---|---|---|---|
| 1,286,008 | 11/1918 | Hughes | 299/91 X |
| 2,155,526 | 4/1939 | Bowman | 299/91 |
| 2,549,088 | 4/1951 | Hettelsater et al. | 299/91 X |
| 2,989,295 | 6/1961 | Prox, Jr. | 299/91 |
| 3,865,195 | 2/1975 | Nelson | 172/123 X |

FOREIGN PATENT DOCUMENTS

| | | | |
|---|---|---|---|
| 252712 | 1/1963 | Australia | 172/123 |
| 960250 | 12/1974 | Canada | 172/123 |
| 754818 | 5/1953 | Fed. Rep. of Germany | 37/189 B |
| 548401 | 10/1942 | United Kingdom | 299/91 |
| 238920 | 4/1969 | U.S.S.R. | 172/123 |

*Primary Examiner*—Paul E. Shapiro

*Attorney, Agent, or Firm*—Burns, Doane, Swecker & Mathis

[57] ABSTRACT

A soil stabilizer comprises a self-propelled vehicle, a rotor having soil-working teeth, and a motor for driving the rotor. The motor is reversible to drive the rotor in opposite directions. The rotor includes tooth holders, each having generally oppositely directed tapered sockets. A tooth is received in one of the sockets so as to project in the direction of rotation. The rotor can thus be effectively utilized in either direction of rotation. The sockets are coplanar and intersect so that the zone of intersection forms an interruption in the tapered engagement between the tooth and socket intermediate the ends thereof to compensate for manufacturing variations in the tapered fit.

1 Claim, 12 Drawing Figures

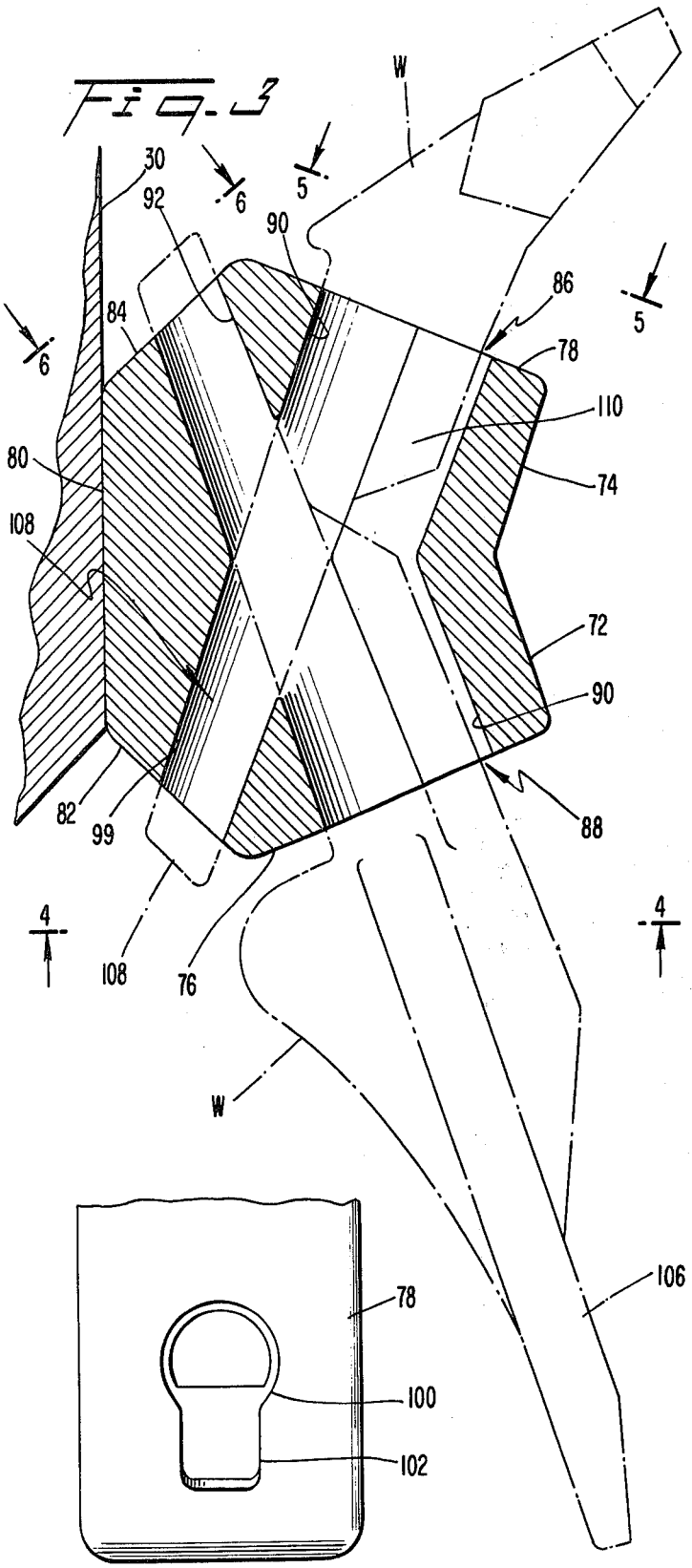
Fig. 3
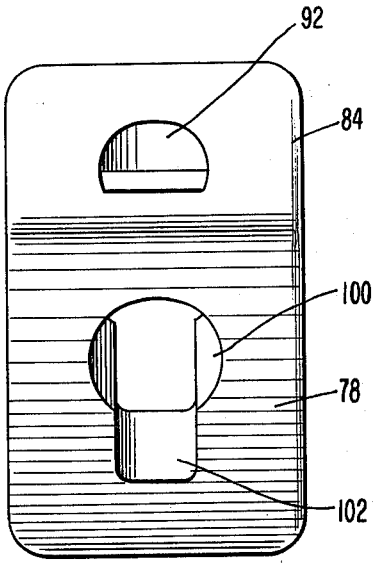
Fig. 4
Fig. 5
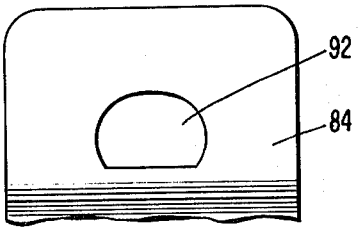
Fig. 6

Fig. 7
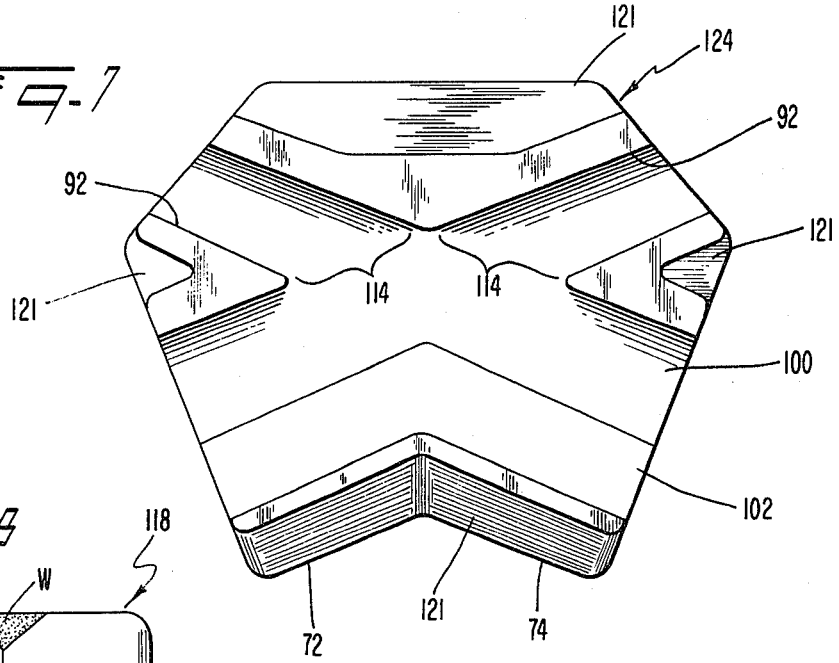
Fig. 8
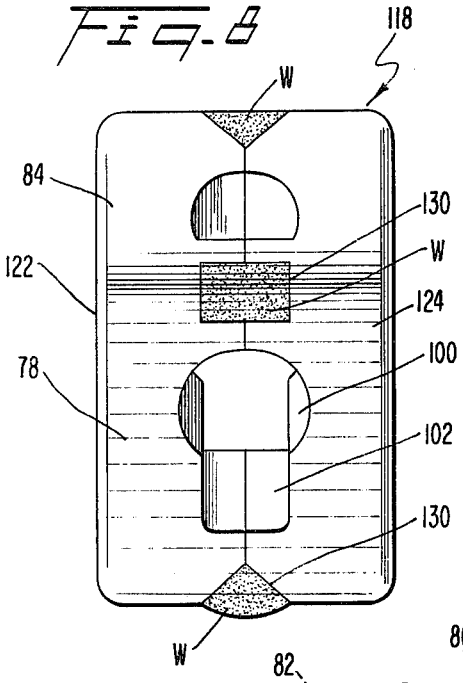
Fig. 9
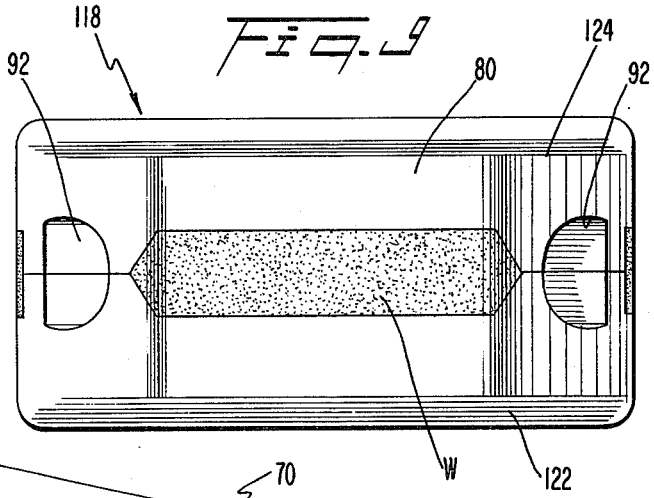
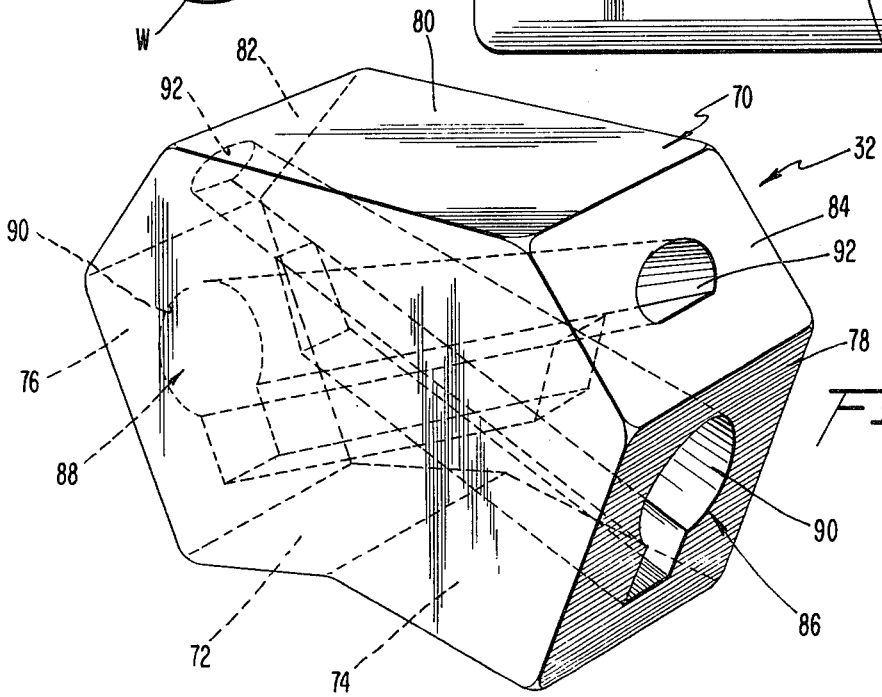
Fig. 10

SOIL STABILIZER AND TOOTH HOLDER THEREFOR

BACKGROUND AND OBJECTS

The present invention pertains to earth working apparatus and more particularly to a self-propelled soil stabilizer which pulverizes and mixes soil over which it travels.

Soil stabilizers are commonly utilized to treat earth by breaking up clumps and effecting a thorough mixing of the soil. Traditionally, soil stabilizers comprise a self-propelled vehicle which propels a rotor having a horizontal axis of rotation. The rotor is driven so that teeth thereon pulverize and mix the soil as the vehicle traverses the ground surface. Exemplary of known soil stabilizer design is that disclosed in U.S. Nelson Pat. No. 3,795,279 issued Mar. 5, 1974 and owned by the assignee of this invention. The disclosure of this patent is incorporated herein by reference as if set forth at length.

Generally, soil stabilizers heretofore proposed have involved a rotor designed for operation in a single direction, whether it be forward or reverse, with the teeth being oriented accordingly. It has been found, however, that depending upon certain variables, such as soil composition and the desired soil treatment for instance, one stabilizer may be less effective than another having an oppositely rotatable rotor. Consequently, the versatility of known stabilizers is considerably limited.

It would be desirable, then, to enhance the versatility of a stabilizer. Moreover, it is desirable that this be accomplished without requiring complex equipment or excessive efforts on the part of an operator to adapt the stabilizer to different conditions.

It is, therefore, an object of the present invention to minimize or obviate problems of the type previously discussed.

It is another object of the invention to provide a novel soil stabilizer.

It is an additional object of the invention to provide a novel stabilizer whose rotor can be easily adapted for rotation in different directions.

It is a further object of the invention to provide a novel mount for a stabilizer tooth.

It is still another object of the invention to provide a novel tooth mounting which effectively retains a tooth during a soil treating operation and promotes rapid reorientation of the tooth for opposite rotation of the rotor.

It is yet another object of the invention to provide a novel tooth mount which effectively retains a tooth absent the need for a separate fastener.

BRIEF DESCRIPTION OF INVENTION

These and other objects are achieved by the present invention wherein a bi-directional rotor is provided with a tooth holder having generally oppositely directed tooth-receiving sockets. A tooth is received in one of the sockets to project toward the direction of rotation. When the rotational direction of the rotor is reversed, the tooth is removed and replaced in the other socket.

In another aspect of the invention, the sockets are tapered to receive a complementarily tapered tooth. The sockets intersect so that an interruption is formed in the tapered connection between the tooth and socket intermediate the ends thereof to provide for two-zone engagement which tends to compensate for manufacturing variances in the tapered fit.

THE DRAWING

Other objects and advantages of the present invention will become apparent from the subsequent detailed description thereof in connection with the accompanying drawings in which like numerals designate like elements, and in which:

FIG. 3 is a side view of a one-piece holder according to the present invention, depicting in phantom two types of teeth alternately mountable therein.

FIG. 4 is a front view of the one-piece holder taken in the direction 4—4 in FIG. 3;

FIG. 5 is a front view of the holder socket taken in the direction 5—5 in FIG. 3;

FIG. 6 is a rear view of the holder socket taken in the direction 6—6 in FIG. 3;

FIG. 7 is a side elevational view of one section of a two-piece holder;

FIG. 8 is a front view of the two-piece holder in an assembled condition;

FIG. 9 is a bottom view of the two-piece holder in an assembled condition;

FIG. 10 is an isometric view of the one-piece holder;

DETAILED DESCRIPTION

Figure 1:
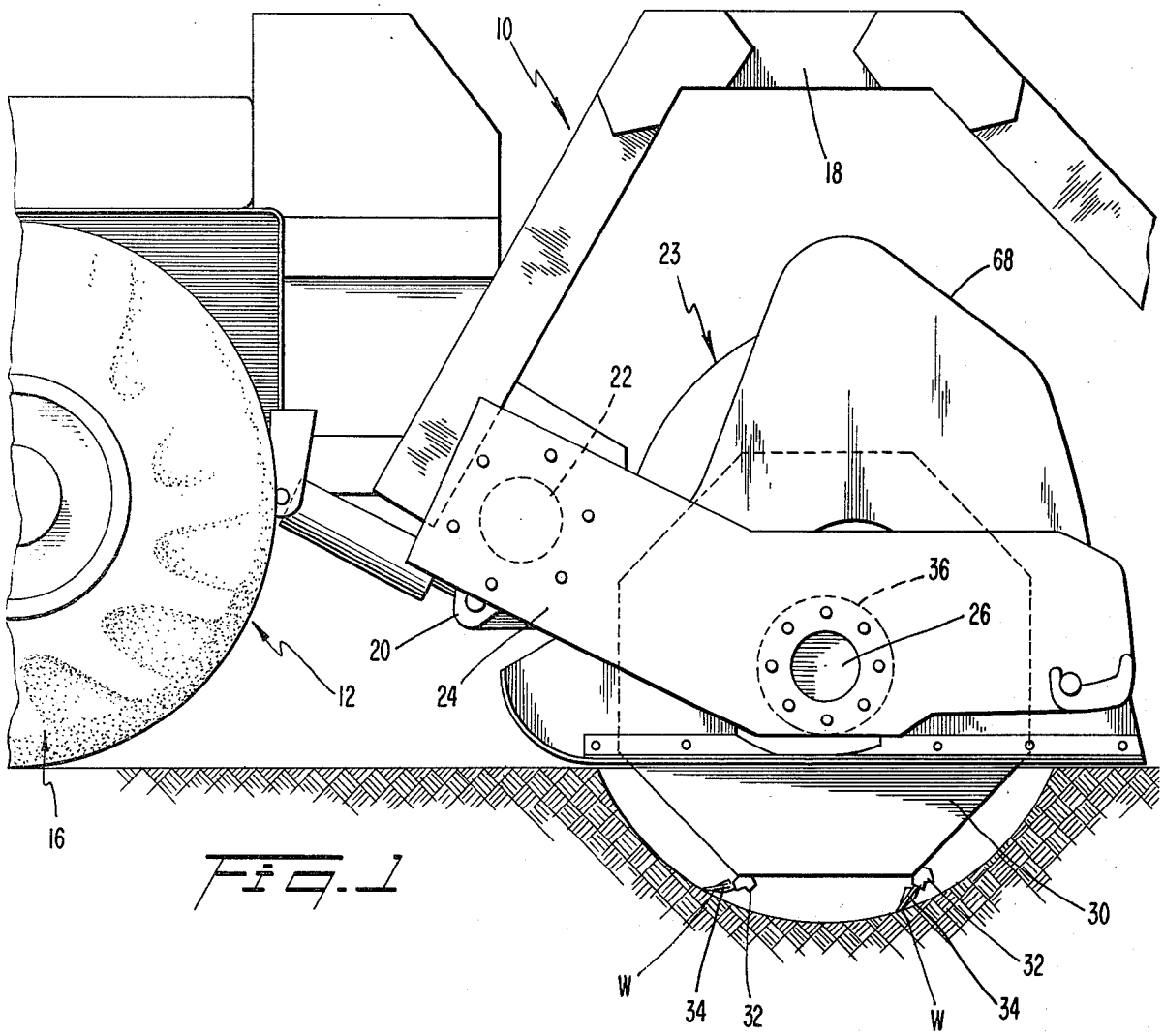
FIG. 1 is a side elevational view of a rotor section of a soil stabilizer according to the present invention.
Figure 2:
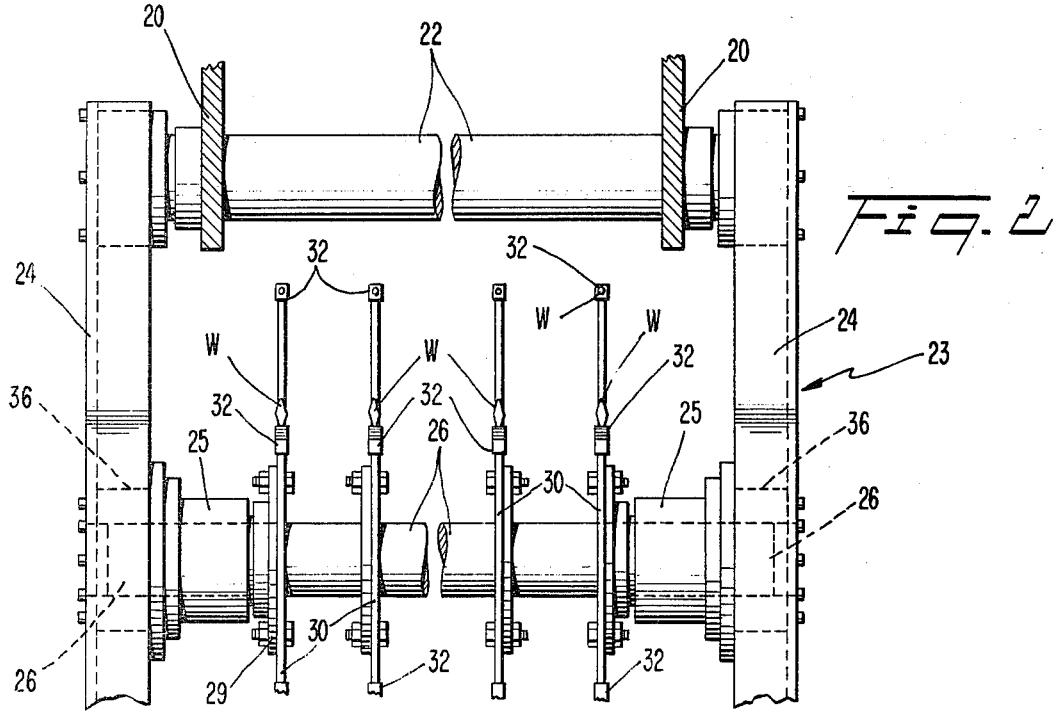
FIG. 2 is a view of the rotor taken from above the dirt cover removed.

A soil stabilizer machine 10 (FIG. 1) according to the present invention comprises a suitable self-propelled vehicle such as a tractor 12. The tractor 12 may be of the type having a pair of drive wheels 16. A U-shaped or goose-neck frame 18 is rigidly attached to and extends rearwardly from the tractor body and carries a pair of rear support wheels (not shown). Connected to the tractor are a pair of drawbars 20 (FIGS. 1 and 2) which extend rearwardly from the tractor and carry at their rearward ends a horizontal cross-tube 22. Rotatably mounted on the ends of the cross-tube are a pair of lifting arms 24.

The lifting arms 24 carry a soil stabilizer unit 23 which includes a horizontal rotor 26. The rotor is mounted in the rear ends of the lifting arms 24 by rotary bearings 25.

The rotor 26 comprises a horizontal shaft carrying a plurality of hub members 29. A plate 30 is bolted to each hub and has a plurality of tooth holders 32 rigidly secured at spaced locations around the plate periphery. If desired, the hubs 29 can be eliminated, and the plates 30 could be welded directly to the rotor 26. Each tooth holder 32 is adapted to carry a tine or tooth 34 for working the soil, as will be discussed subsequently in greater detail.

The rotor 26 is rotated by one or more low speed, high torque hydraulic motors 36. A pair of such motors can be provided and are mounted on the lifting arms 24. Preferably, the output shafts of the motors 36 are directly connected to the ends of the rotor shaft 26, although any suitable coupling arrangement between the motors and the rotor could be provided.

Figure 11:
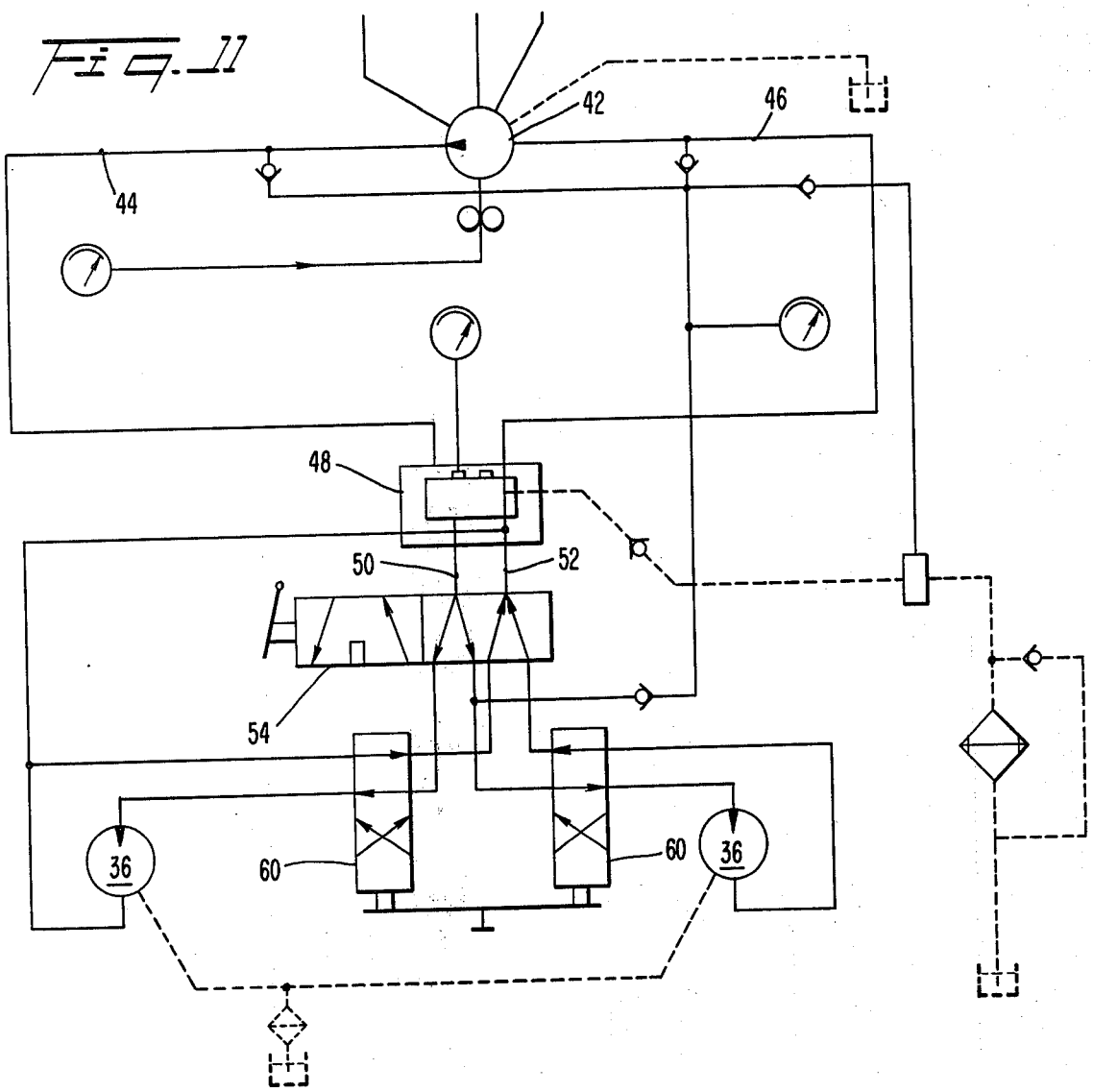
FIG. 11 depicts part of a first hydraulic circuit for operating the tor.
Figure 12:
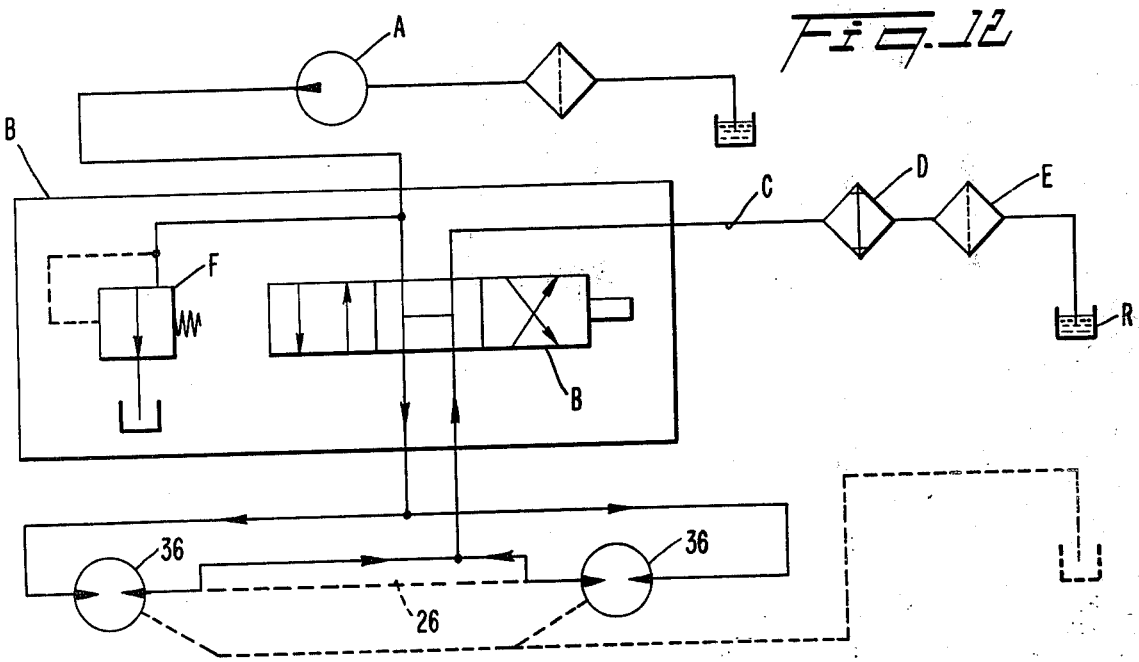
FIG. 12 depicts a second hydraulic circuit for operating the rotor.

The motors 36 can be driven in any convenient fashion, such as by hydraulic systems depicted in FIGS. 11 or 12. Many details of the FIG. 11 system are fully described in the aforementioned Nelson patent and need not be described at length herein. Briefly, though, the system includes a hydraulic pump 42 which is connected by fluid lines 44 and 46 to a cross-over relief valve 48 and the latter is connected by hydraulic fluid lines 50, 52 to a manually operable series parallel two-speed rotor speed range selection valve 54. The valve 54 controls the speed range of the motors 36. When the valve 54 is open, the motors 36 are rotated to drive the rotor 26. Suitable means is provided for reversing the direction of rotation of the motors 36. For example, a pair of reversing valves 60 can be provided in the hydraulic circuit and controlled by a suitable control at the operator's console. Preferably, the valves are connected together to operate in unison. In one position of the reversing valves 60 the rotor is rotated in one direction (e.g., clockwise ad viewed in FIG. 1). By reversing the valves 60 the rotor 26 can be made to rotate in the opposite direction (e.g., counterclockwise as viewed in FIG. 1).

Alternatively, a drive control for the pump 42 can be provided to selectively rotate the pump 42 in either direction so as to reverse the direction of the motors 36.

Alternatively, an open loop hydraulic system can be employed, as illustrated in FIG. 12. In this system, a fixed displacement pump A is connected to a four-way, three-position, spring centered directional control valve B. A return line C is connected to a reservoir R through a fluid cooler D and a filter E. The valve B is situated at the machine operator's console and can be selectively actuated to reverse the direction of rotation of the motors 36. A pressure relief valve F is provided which protects the pump and motors from over-pressure.

It will be appreciated that other arrangements will be apparent to one skilled in the art for reversing the rotary direction of the rotor 26.

A dirt shield 68 is connected to the lifting arms 24.

Suitable raising and lowering devices, such as hydraulic piston-cylinder assemblies are connected between the tractor and the lift arms for raising and lowering the stabilizer unit 23.

Referring now to FIGS. 3–6 and 10, a tooth holder 32 of one-piece construction will be described. The tooth holder 32 can be formed by casting and comprises a body portion 70 having a pair of mutually angled mounting surfaces 72, 74, first and second receiving surfaces 76, 78 extending respectively, at right angles relative to the mounting surfaces 72, 74, a top surface 80, and first and second transition walls 82, 84 extending between the top surface 80 and the first and second receiving surfaces 82, 84, respectively.

A pair of intersecting sockets 86, 88 are formed in the body 70. Each socket 86 has a forward end 90 formed in the first and second receiving surfaces 76, 78 and a rearward end 92 formed in the first and second transition walls 82, 84.

The sockets 86, 88 are essentially coplanar and extend at an angle relative to one another. An angle of forty degrees has been found desirable in one preferred form of the invention. Each socket 86, 88 includes a generally annular shank receiving portion 100 and a generally rectangular key receiving portion 102 extending from the shank receiving portion 100 (FIG. 4). The shank receiving portion 100 tapers inwardly from the forward end 90 to the rearward end 92 in generally frusto-conical fashion.

The sockets 86, 88 are each adapted to receive a ground-working tooth W, for example, either of those depicted in FIG. 3. Such a tooth is conventional and has a cutter head 106, a mounting shank 108 and a key 110. The mounting shank 108 is tapered frusto-conically in generally complementary fashion to each shank receiving portion 100 of the sockets so as to be capable of being forced or wedged into the socket to effect a tight friction fit therein. The key 110 of the tooth enters the key receiving portion 102 of the socket to prevent rotation of the tooth in its socket. Such knock-in, knock-out teeth are conventional and need not be described in further detail.

When installed within a socket 86 or 88, a back end of the tooth shank 108 projects from the rearward end 92 of the socket and is adapted to be engaged by a removal tool, such as a hammer. Since the sockets 86, 88 intersect, the holder carries only one tooth at a time.

In FIGS. 7–9, there is depicted an alternate form of holder 118 which is fabricated of two sections 122, 124 as by forging, for example. These sections 122, 124 are joined along a plane which extends end-to-end through the socket. Each section 122, 124 is provided with recesses 121 which, when the sections 124, 122 are mated, define V-notches 130 around the periphery of the holder for the reception of weld joints W.

Internally, the two-piece holder, once assembled, is essentially the same as the one-piece holder 32, and the parts thereof have been designated by similar numerals.

Since the sockets 86, 88 of the holders 32 or 118 intersect, the contact area between the tapered shank 108 of the tooth and the shank-receiving portion 100 of the socket is interrupted along an intermediate zone 114 defined by the intersection of the sockets 86, 88 (see FIG. 7).

It has been found that these zones of interruption contribute to the effective securement of the tooth within the socket. That is, such an interruption tends to compensate for manufacturing variations in taper of the tooth or socket and divides the tapered contact in separate segments located on opposite sides of the interruption. This enhances the ability of the socket to grip more firmly the shank of a tooth when normal tolerance variations are involved. Hence, the need for a separate fastener is avoided.

It will be realized that when reversal of a tooth W is desired, it is merely necessary that the tooth be knocked from its socket and then knocked into the opposite socket of the associated holder. Consequently, the rotor 26 will be adapted for reverse rotation with the teeth still located in an optimum cutting angle. This can be achieved in a minimum amount of time, thereby considerably enhancing the versatility of the rotor.

In operation, the rotor 26 is rotated in a direction suited to the nature of the soil being worked and the desired soil condition to be achieved, among other factors. The tooth holders 32 each carry a single tooth projecting toward the direction of rotation. That is, the cutting head of the tooth will be pointed in the direction of rotation. The teeth will be secured by a tapered, friction fit which is interrupted intermediate the ends of the tooth shank due to the criss-crossing or intersecting nature of the sockets 86, 88. In this manner, manufacturing variations in taper will tend to be compensated for.

If the direction of rotation of the rotor is to be reversed, it is merely necessary to knock each tooth from its holder and insert it in the other socket so as to project in the opposite direction, i.e., it will project in the new direction of rotation. There will again be present an interruption in the tapered engagement between the tooth and socket to provide for a two-zone frictional contact.

Although the invention has been described in connection with a preferred embodiment thereof, it will be appreciated by those skilled in the art that additions, modifications, substitutions and deletions not specifically described may be made without departing from the spirit and scope of the invention as defined in the appended claims.

What is claimed is:

1. In a soil stabilizer of the type including a self-propelled vehicle, a rotor having a plurality of teeth and being rotatable about a horizontal axis, and drive means for rotating the rotor to pulverize soil, the improvement wherein:

said drive means includes means for rotating said rotor in opposite directions, and said rotor includes a plurality of tooth holders, each holder having generally oppositely directed coplanar tooth-receiving sockets for selectively receiving a tooth projecting toward the direction of rotation, said sockets and teeth being complementarily tapered to provide a friction fit therebetween, said sockets intersecting one another so that a friction-generating tapered engagement between the socket and the tooth occurs at front and rear ends of the tooth and is interrupted therebetween by the zones of intersection of said sockets so that manufacturing variations in taper of the tooth tend to be compensated for, said sockets being rearwardly open to permit engagement of the tooth with a removal tool; and said holder comprising two half sections that are divided along a vertical plane extending end-to-end through said sockets, said sections being connected by weld joints.

* * * * *